US010984762B2

(12) United States Patent
Kudirka et al.

(10) Patent No.: US 10,984,762 B2
(45) **Date of Patent: *Apr. 20, 2021**

(54) DETACHABLE FRETBOARD WITH CUSTOMIZED FRETS

(71) Applicants: Michael P. Kudirka, Rapid City, MI (US); Matthew Knudstrup, Rapid City, MI (US); Scott Knudstrup, Allston, MA (US)

(72) Inventors: Michael P. Kudirka, Rapid City, MI (US); Matthew Knudstrup, Rapid City, MI (US); Scott Knudstrup, Allston, MA (US)

(73) Assignee: MicroTone Guitars, LLC, Rapid City, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/779,388

(22) Filed: Jan. 31, 2020

(65) Prior Publication Data

US 2020/0251077 A1 Aug. 6, 2020

Related U.S. Application Data

(63) Continuation-in-part of application No. 16/265,846, filed on Feb. 1, 2019, now Pat. No. 10,643,584.

(51) Int. Cl.
*G10D 3/095* (2020.01)
*G10D 1/08* (2006.01)

(52) U.S. Cl.
CPC ..... *G10D 3/095* (2020.02); *G10D 1/08* (2013.01)

(58) Field of Classification Search
CPC ..... G10D 3/095; G10D 1/08
See application file for complete search history.

(56) References Cited

U.S. PATENT DOCUMENTS

| | | | | |
|---|---|---|---|---|
| 4,132,143 | A | 1/1979 | Stone | |
| 5,631,432 | A | 5/1997 | Muncy | |
| 6,037,532 | A | 3/2000 | Beckmeir | |
| 10,643,584 | B1 * | 5/2020 | Kudirka | G10D 1/05 |
| 2006/0048628 | A1 | 3/2006 | Huwaldt | |
| 2009/0056520 | A1 | 3/2009 | Rivera et al. | |
| 2018/0068641 | A1 | 3/2018 | Allred, III et al. | |
| 2018/0218717 | A1 | 8/2018 | Varona | |

OTHER PUBLICATIONS

Rankin, "Mark Rankin's Interchangeable Fretboards"; website capture alleged Jan. 15, 2012 (Jan. 15, 2012), online http://www.friendsoffreedom.com/Friends/Rankin/Mark_Rankin.html.
PCT Search results dated Jun. 10, 2020; PCT App No. PCT/US 20/16282, Lee Young (2020).

* cited by examiner

*Primary Examiner* — Kimberly R Lockett
(74) *Attorney, Agent, or Firm* — Schrantz Law Firm, PLLC; Stephen D. Schrantz

(57) ABSTRACT

The fretboard system provides a replaceable fretboard with customized placement of frets along the fretboard for a stringed instrument. A configuration of magnets on the neck of the stringed instrument secure the fretboard to the stringed instrument. The magnets attract a metallic underside, such as a sheet metal, of the detachable fretboard. A separating layer, including but not limited to a layer of wood or other composite material, separates the magnets from the sheet metal. At least one, preferably two or more, reinforcing members extend longitudinally along the neck of the stringed instrument to reinforce the neck.

20 Claims, 20 Drawing Sheets

DETACHABLE FRETBOARD WITH CUSTOMIZED FRETS

CROSS-REFERENCE TO RELATED APPLICATIONS

This application claims priority to and is a continuation in part of U.S. patent application Ser. No. 16/265,846 entitled "Detachable Fretboard with Customized Frets" filed on Feb. 1, 2019.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

I. Field of the Invention

The present invention relates generally to a customized fretboard. More specifically, the present invention relates to a removable fretboard that enables users to customize placement of the frets along the fretboard of a stringed musical instrument, including but not limited to a guitar.

The removable fretboard provides a receiver, such as a guide aperture, that mates with the stringed instrument, including but not limited to a guitar. In one embodiment, the neck of the stringed instrument provides a guide finger with which the guide aperture mates for placement of the fretboard on the neck. Another embodiment provides an attachment finger on the neck that assists with installing and orienting the fretboard on the neck. The attachment finger moves along a corresponding track of the fretboard into an attachment aperture within the fretboard. The guide finger and attachment finger orient the fretboard on the neck. The attachment finger of the neck inserted into the attachment aperture of the fretboard limits movement of the fretboard on the neck.

II. Description of the Known Art

Patents and patent applications disclosing relevant information are disclosed below. These patents and patent applications are hereby expressly incorporated by reference in their entirety.

U.S. Pat. No. 6,037,532 issued to Beckmeir on Mar. 14, 2000 ("the '532 patent") teaches a stringed musical instrument having an elongate neck and a body which may have a resonant cavity at one end and a head at the other end thereof. The '532 patent teaches that strings extend across the neck and, when vibrated, generate musical sounds. The invention taught by the '532 patent relies upon fingerboards which are removable so that a fingerboard can easily be repaired and replaced, or otherwise so that one fingerboard may be substitutable for another type of fingerboard in order to generate sounds of different timber or of different qualities. The fretted fingerboards taught by the '532 patent are substitutable for non-fretted fingerboards. Moreover, the fingerboards taught by the '532 patent are slid into and out of slots having beveled edges in the neck of the instrument. By using double beveled slots, that is, a first bevel relative to the thickness of the fingerboard, and a second bevel relative to the transverse dimension of the fingerboard, the fingerboard taught by the '532 patent can be slid into a slot from one side of the neck and will precisely lie in proper marginal registration on that neck. The '532 patent teaches that other types of attachment mechanisms for holding the fingerboard on the neck are also provided. Depending upon the material of construction of the musical instrument, and which is usually wood, the neck taught by the '532 patent may be reinforced by a reinforcing member extending through the neck and into the head and the body.

U.S. Pat. No. 4,132,143 issued to Stone on Jan. 2, 1979 ("the '143 patent") teaches that a fretted stringed musical instrument with a readily removable fingerboard to enable performance of musical compositions written in different tonal scales by removing a fingerboard having fret placement in accordance with one tonal scale, e.g. equal tempered scale, and installing another fingerboard having fret placement in accordance with a different tonal scale, e.g. just intonation scale. The '143 patent teaches that several alternate arrangements permit a given fingerboard to be quickly installed or removed without removing or slackening the strings so that fingerboards may be exchanged in the course of a concert to permit performance of musical pieces from several tonal systems on a single basic instrument.

The known art does not provide a similar attachment structure as the known art requires either beveled edges or magnets on both the fingerboard and the neck. The known art also does not provide the same reinforcement provided by the present invention as the present invention provides a layer of neck material adjacent the fretboard instead of a reinforcing member and also provides a metallic layer, such as a sheet metal.

The present invention provides an improved system that reinforces the neck while also providing an improved attachment of the fretboard to the neck. Such attachment of the present invention limits movement of the fretboard on the neck.

SUMMARY OF THE INVENTION

The improved fretboard of the present invention provides a replaceable fretboard with customized placement of frets along the fretboard. These frets may include at least one fret segment or multiple fret segments that are placed laterally across the neck. The fretboard provides individual grooves cut laterally into the fretboard. The individual grooves accept insertion of the fret segment(s). The grooves are cut the length of each fret segment required to achieve the tuning desired by the user.

The user installs the desired fretboard on the stringed instrument. In one embodiment, a unique configuration of magnets secures the fretboard to the stringed instrument. The fretboard of the present invention detaches from the stringed instrument. A different fretboard with different customized frets can then be attached to the stringed instrument. Installation of a different customized fretboard adjusts the sound of the stringed instrument to the user's desired configuration.

The present invention provides magnets installed on the neck of the stringed instrument. The magnets attract a metallic underside of the detachable fretboard. In one embodiment, a sheet metal is secured to the attachment side of the fretboard. The magnets secure the metallic attachment side to the neck of the stringed instrument. A separating layer, including but not limited to a layer of wood or other composite material, separates the magnets from the sheet metal. Such a separating layer provides a smooth layer for securing the fretboard to the neck. The separating layer reduces movement of the fretboard on the neck. Such movement of the fretboard may affect playing of the instrument and may affect the sound produced by the instrument.

The present invention also reinforces the neck of the stringed instrument. Removing the fretboard reduces the strength of the neck that is tensioned by the strings. The present invention provides at least one, preferably two or more, reinforcing members, that extend longitudinally along the neck. The reinforcing members of one embodiment are constructed from a carbon fiber. The present invention also provides one metallic layer that increases the strength of the fretboard and the neck.

The removable fretboard provides a receiver, such as a guide aperture, that mates with the guitar. In one embodiment, the neck of the stringed instrument provides a guide finger with which the guide aperture of the fretboard mates for placement of the fretboard on the neck. Another embodiment provides an attachment finger on the neck and attachment aperture for installing and orienting the fretboard on the neck. The attachment finger moves along a corresponding track into an attachment aperture. The guide finger and attachment finger orient the fretboard on the neck. The attachment finger inserted into the attachment aperture limits movement of the fretboard on the neck.

It is an object of the present invention to provide a customized fretboard with customized placement of the frets.

It is an object of the present invention to provide unique configurations of the frets.

It is also an object of the present invention to provide a removable fretboard for customization of a stringed instrument.

It is also an object of the present invention to provide a method of producing a customized fretboard.

It is also an object of the present invention to reinforce the neck of the stringed instrument.

It is also an object of the present invention to attach the fretboard to the neck with a magnetic attachment.

It is also an object of the present invention to provide a separating layer between the magnets and the fretboard.

It is also an object of the present invention to reduce movement of the fretboard on the neck.

It is also an object of the present invention to direct the fretboard to proper orientation on the stringed instrument.

It is also an object of the present invention to limit movement of the fretboard on the neck.

These and other objects and advantages of the present invention, along with features of novelty appurtenant thereto, will appear or become apparent in the course of the following descriptive sections and the attached drawings.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

The present invention relates generally to a fretboard system generally shown as 100. The fretboard 106 attaches to the stringed instrument, such as a guitar. Musicians may require different placement of frets for capturing unique tonalities necessary for the music. The detachable fretboard 106 of the present invention provides the musician with the ability to customize the frets and the resulting frequencies of vibrating strings produced by the instrument. The user attaches the fretboard 106 needed for playing the instrument.

Figure 1:
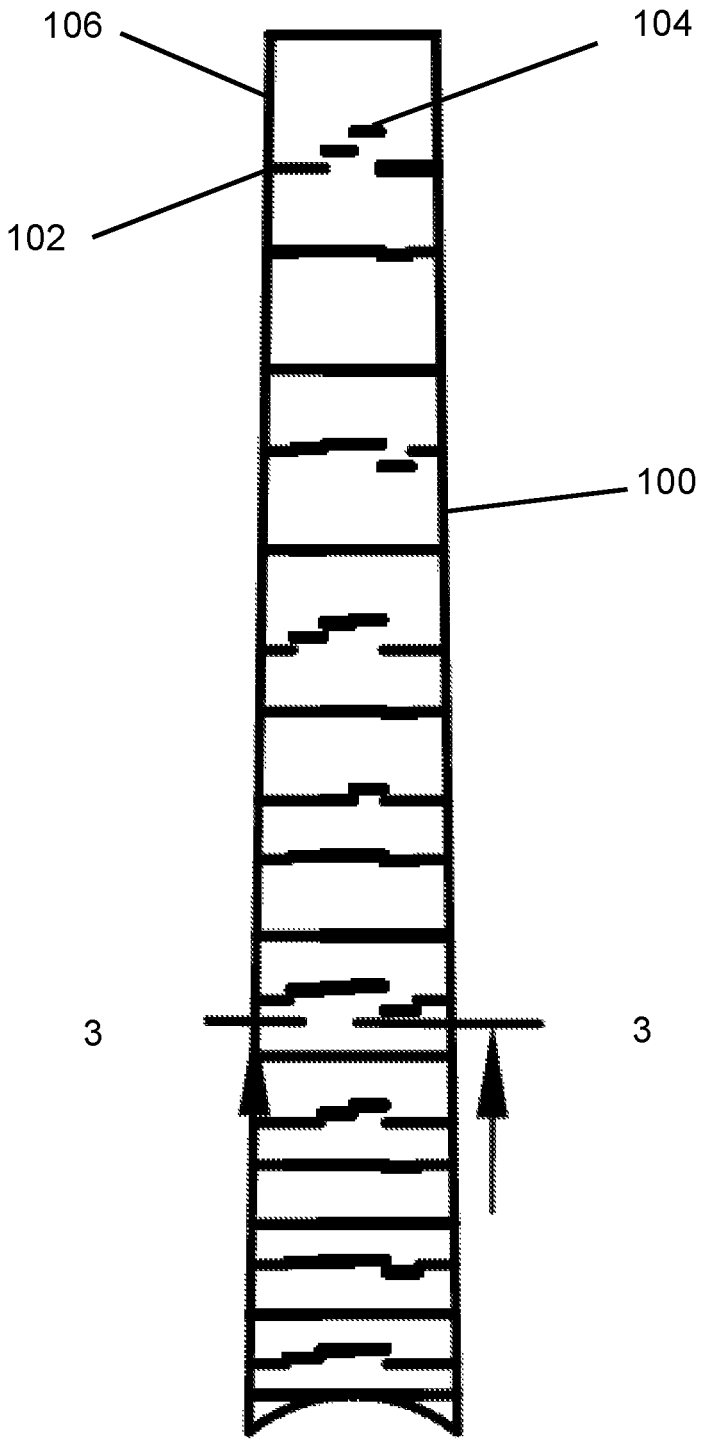
FIG. 1 is a front view showing one embodiment of the present invention.

Referring to FIG. 1, the fretboard 106 extends along a longitudinal axis. The fret segments 102, 104 extend laterally across the fretboard 106. The fret segments 102, 104 are placed according to the pitch needed to be produced. The placement of the fret segments 102, 104 are determined according to a formula for achieving the desired tuning.

A computing device calculates the placement of the fret segments 102, 104 for the desired tuning. A machine then cuts a channel within the upper surface of the fretboard 106 for placement of the fret segment.

The computing device also identifies the length of the fret segment 102, 104 to be installed in the fretboard 106. The length of fret wire needed for the fret segment is then cut for placement into the channel. In one embodiment, a machine cuts the length of fret wire needed for the channel.

The fret segment is then inserted into the channel to secure the fret segment with the fretboard 106. In one embodiment, the fret segment is hammered into the fretboard 106.

Figure 2:
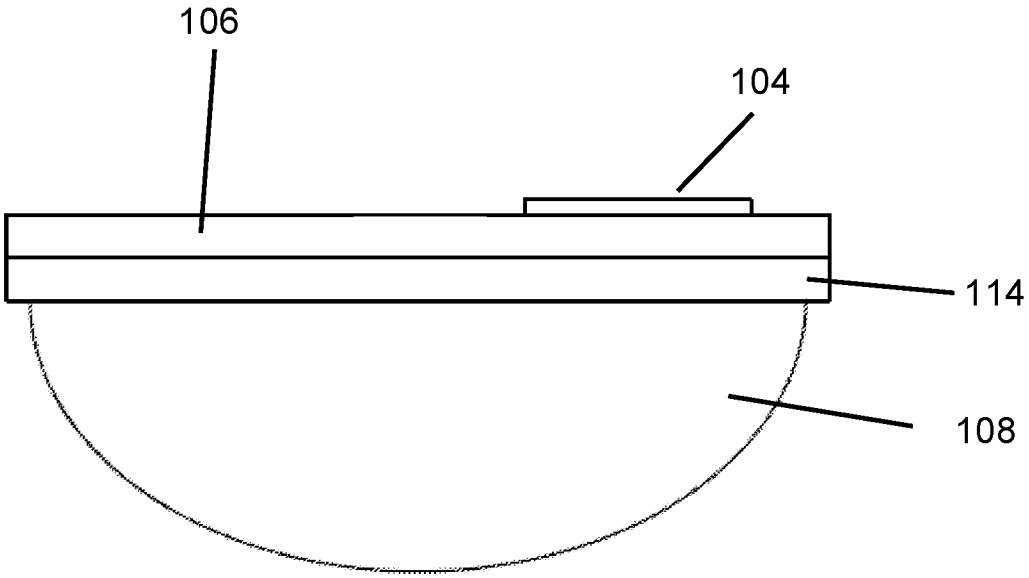
FIG. 2 is a bottom view thereof.

FIG. 2 shows a side view of the neck 108 with the fretboard 106 and fret segment 102 secured to the neck 108.

A separating layer 114 separates the fretboard 106 from the neck 108. The separating layer 114 provides an isolation layer from the magnets that secure the fretboard 106 to the neck 108.

Figure 3:
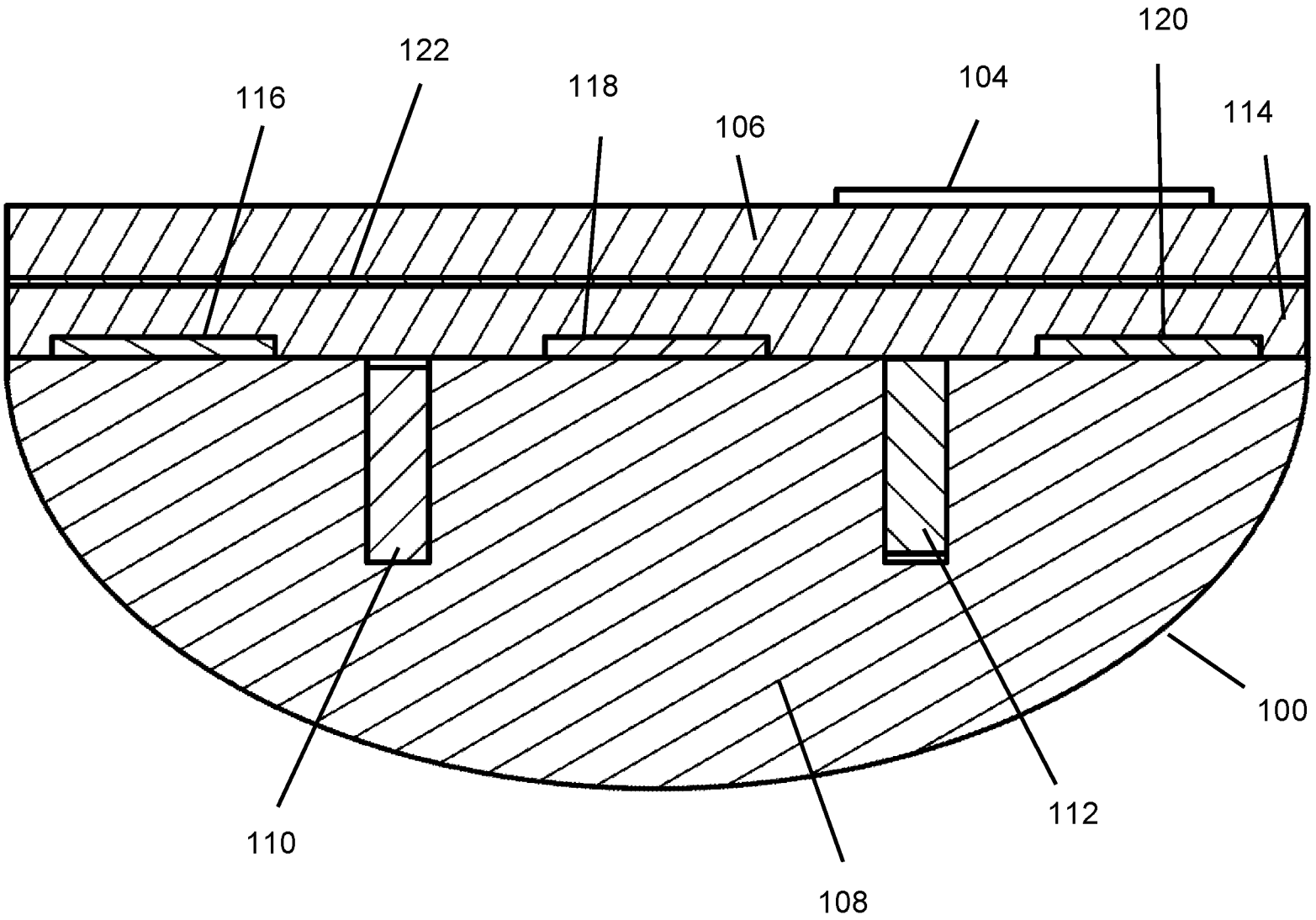
FIG. 3 is a sectional view thereof.

FIG. 3 shows a side view of the neck 108 secured to the fretboard 106 with fret segment 104. Magnets 116, 118, 120 secure the fretboard 106 to the neck 108. The magnets 116, 118, 120 are secured to the neck 108. Separating layer 114 also secures to the neck 108. The magnets 116, 118, 120 and separating layer 114 are affixed to the neck 108. In one embodiment, an adhesive secures the magnets 116, 118, 120 and the separating layer 114 to the neck 108.

The separating layer 114 installs vertically above the magnets 116, 118, 120. Separating layer 114 of one embodiment is constructed from wood, wood composite, or other material from which guitars are constructed. In one embodiment, the separating layer 114 is constructed from a paper composite material, a phenolic resin/cellulose composite material, or a material such as Richlite. In one embodiment, the separating layer and the fretboard are constructed from the same material, including but not limited to, a paper composite material, a phenolic resin/cellulose composite material, or a material such as Richlite.

The fretboard 106 secures to the neck 108 via magnets 116, 118, 120. The fretboard 106 of one embodiment is constructed from wood, wood composite, or other material from which guitars are constructed. In one embodiment, the fretboard 106 is constructed from a paper composite material, a phenolic resin/cellulose composite material, or a material such as Richlite.

The neck 108 of one embodiment is constructed from wood, wood composite, or other material from which guitars are constructed. In one embodiment, the neck 108 is constructed from a paper composite material, a phenolic resin/cellulose composite material, or a material such as Richlite.

A metallic layer 122 secures to the fretboard 106. In one embodiment, an adhesive secures the metallic layer affixed to the fretboard 106. Magnets 116, 118, 120 secured to the neck 108 attract the metallic layer 122. The magnetic attraction of the magnets 116, 118, 120 with the metallic layer 122 secures the fretboard 106 to the neck 108.

The use of metallic layer 122 with magnets 116, 118, 120 provide sufficient alignment of the magnets 116, 118, 120 with the metallic layer 122. The increased size of the attraction surface of the magnetic layer 122 provides an improved attachment of the neck 108 with the fretboard 106. The increased surface area reduces movement of the fretboard 106 on the neck 108. In one embodiment, the metallic layer is a sheet metal, such as steel or other ferrous metals. The metallic layer 122 also provides additional reinforcement of the neck and the fretboard.

The neck 108 is also reinforced with reinforcing members 110, 112 extending longitudinally through the neck 108. The reinforcing members 110, 112 reinforce the neck 108 to allow for removal of the fretboard 106 from the neck 108. With the fretboard 106 removed, the neck 108 will be tensioned due to the strings causing strain on the neck 108 that could damage the stringed instrument. The reinforcing members 110, 112 strengthen the neck 108.

The reinforcing members 110, 112 are constructed from a rigid material to support the neck 108. In one embodiment, the reinforcing members 110, 112 are constructed from carbon fiber to support the neck 108. The reinforcing members 110, 112 are positioned within grooves running longitudinally through the neck 108.

Figure 4:
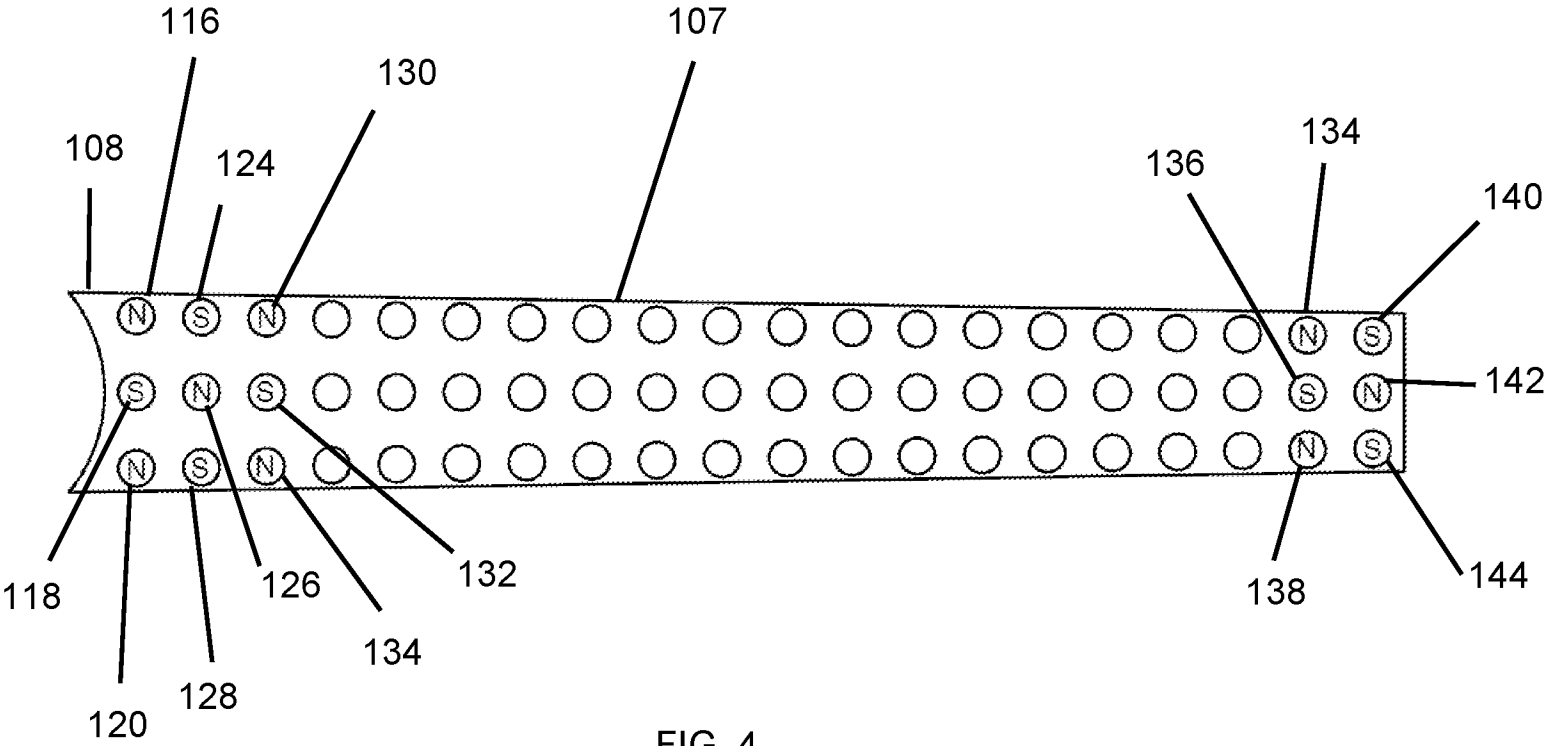
FIG. 4 is a sectional view thereof.

FIG. 4 shows the attachment surface 107 for securing the fretboard to the neck 108. Magnets 116, 118, 120, 124, 126, 128, 130, 132, 134, 136, 138, 140, 142, 144 secure to the neck 108 to form the attachment surface 107. The magnets 116, 118, 120, 124, 126, 128, 130, 132, 134, 136, 138, 140, 142, 144 affix to the neck 108. In one embodiment, the magnets 116, 118, 120, 124, 126, 128, 130, 132, 134, 136, 138, 140, 142, 144 adhere to the neck 108 via an adhesive.

In one embodiment, the magnets 116, 118, 120, 124, 126, 128, 130, 132, 134, 136, 138, 140, 142, 144 are arranged with alternating polarity as shown in FIG. 4. Magnets 116, 118, 120, magnets 124, 126, 128, magnets 130, 132, 134, and the magnets extending to magnets 136, 138, 140, and magnets 140, 142, 144 alternate polarity laterally across the neck 108. Similarly, magnets 116, 124, 130 to magnets 134, 140, magnets 118, 126, 132, to magnets 136, 142, and magnets 120, 128, 134 to magnets 138, 144 alternate polarity longitudinally across the neck 108. The polarity of the magnets is demonstrated by N (north) and S (south). The magnets can be arranged according to a different polarity.

The magnets 116, 118, 120, 124, 126, 128, 130, 132, 134, 136, 138, 140, 142, 144 attract the fretboard to the neck to secure the fretboard to the neck 108. The magnets 116, 118, 120, 124, 126, 128, 130, 132, 134, 136, 138, 140, 142, 144 attract the metallic layer of the fretboard.

Figure 5:
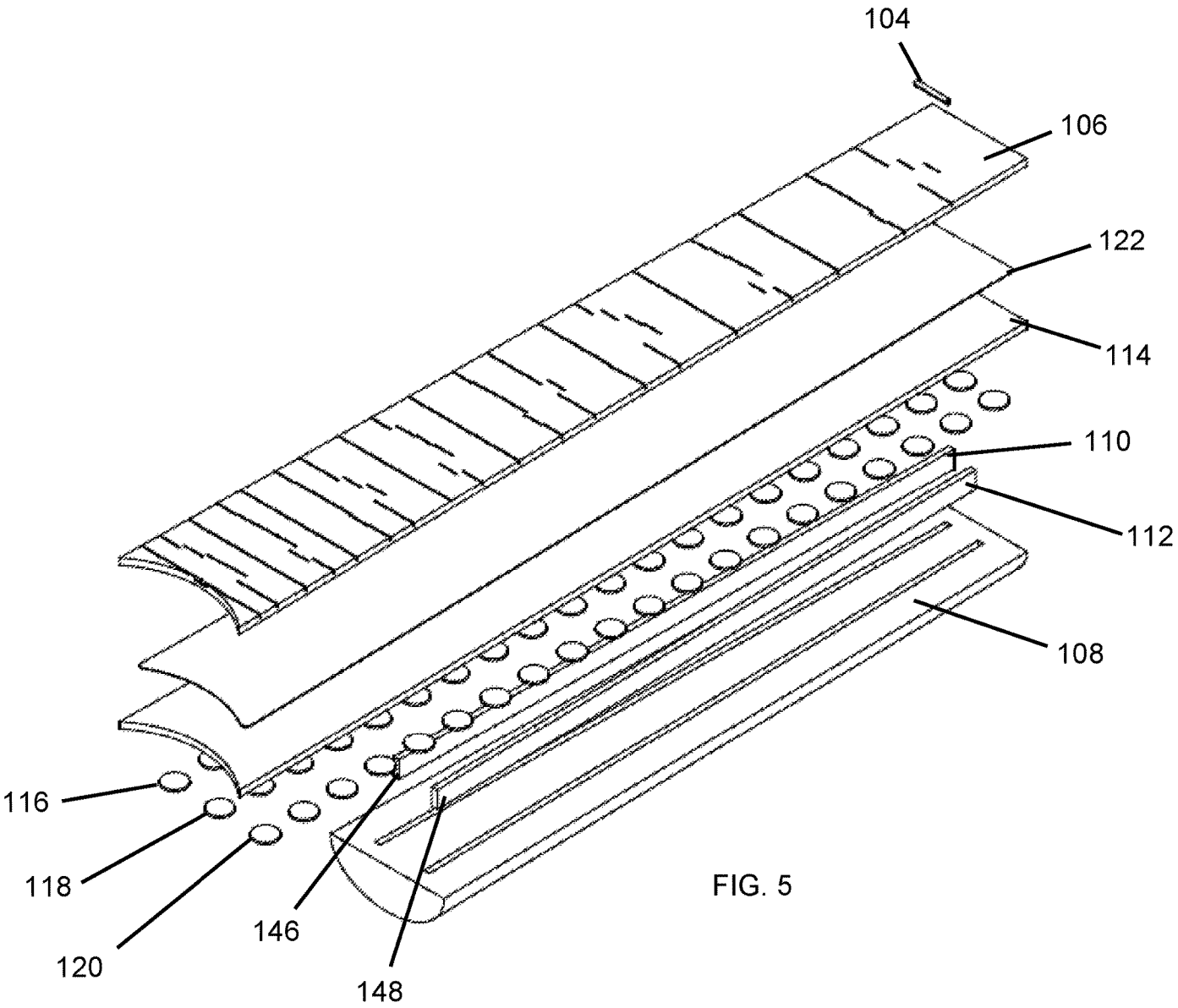
FIG. 5 is an exploded view thereof.

FIG. 5 shows an exploded view of the detachable fretboard 106 and neck 108 assembly. The fret segment 104 inserts into a groove in the fretboard 106. The metallic layer 122 secures vertically below the fretboard 106 for attraction to the magnets 116, 118, 120 secured to the neck 108. The metallic layer 122 and fretboard 106 are affixed together to form a first component that attaches to the neck 108.

The neck 108, magnets 116, 118, 120, and separating layer 114 secure to each other to form a second component that serves as a base for attracting the fretboard 106 and metallic layer 122.

The reinforcing members 110, 112 insert into the grooves 146, 148. The reinforcing members 110, 112 strengthen the neck 108 to counter the tension on the neck due to the strings.

Figure 7:
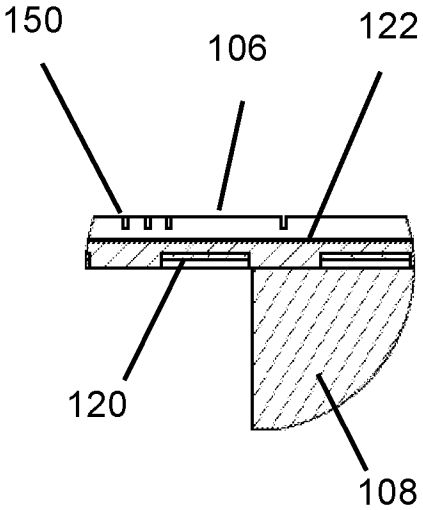
FIG. 7 is a sectional view thereof.
Figure 6:
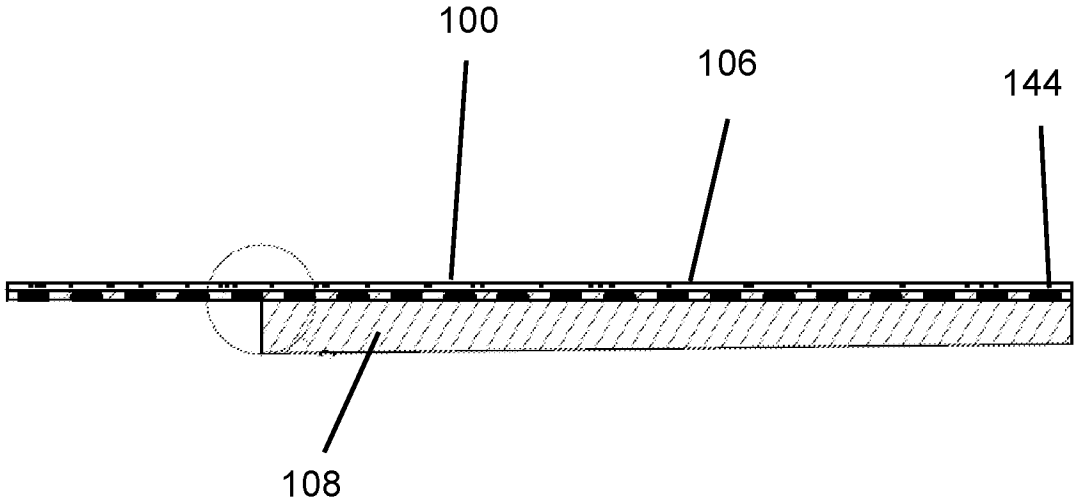
FIG. 6 is a sectional view thereof.

FIGS. 6 and 7 show a sectional view of the fretboard system 100. The fretboard 106 and metallic layer 122 position vertically above the magnets 120, 144 and the separating layer 114 that are adhered to the neck 108.

FIG. 7 shows the fret apertures 150 that are positioned throughout the fretboard 106. The fret segments insert into the fret apertures 150 that are located within the fretboard 106. A metallic layer secured to the fretboard 106 is located vertically below the fretboard 106. The separating layer 122 provides a layer of rigid to somewhat rigid material between the magnets 120 and the fretboard 106. The magnets 120 and separating layer secure to the neck of the guitar 108 as shown in FIG. 7. In one embodiment, an adhesive secures the magnets and the separating layer to the neck 108. An adhesive also secures the metallic layer to the fretboard 106.

Figure 8:
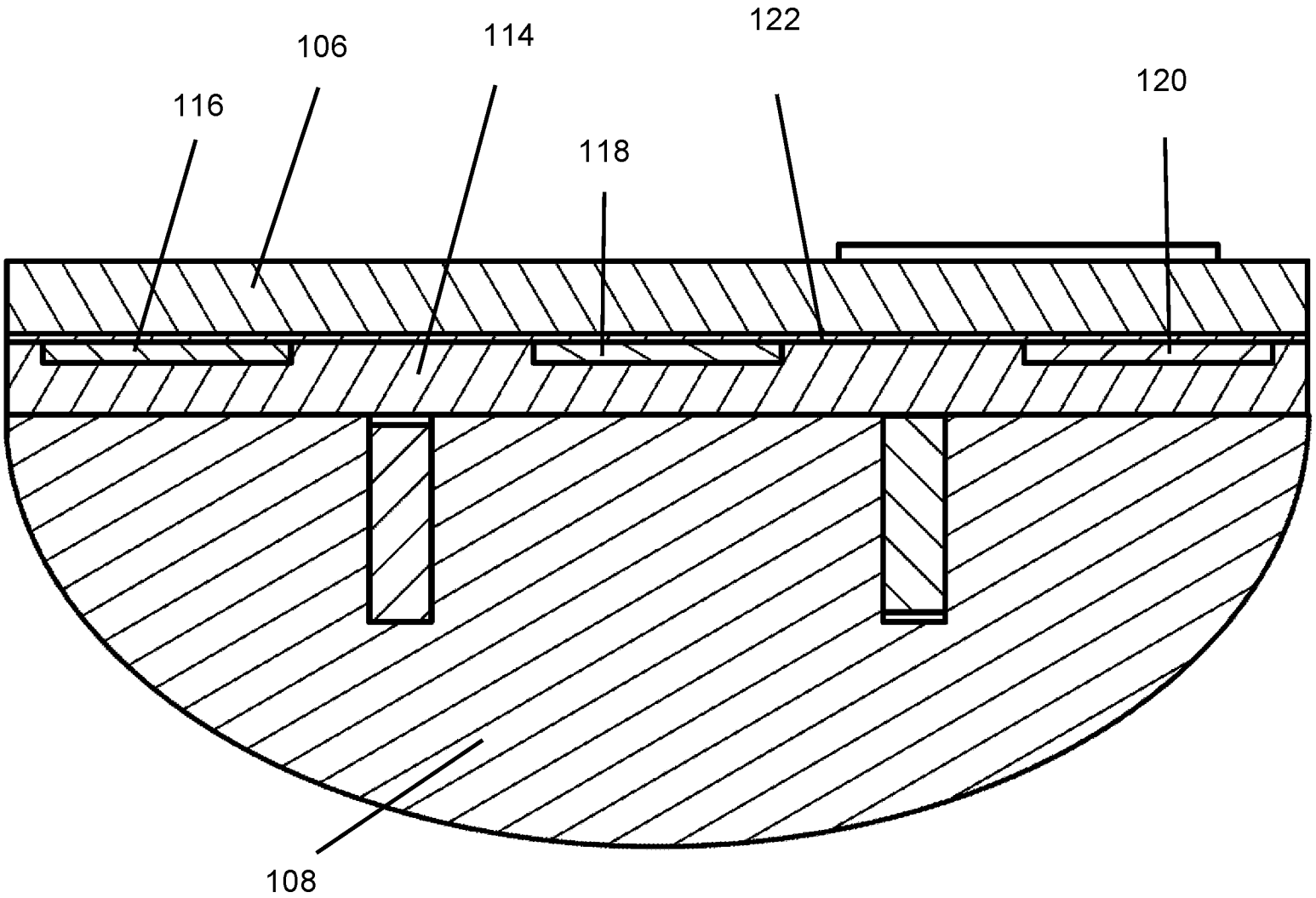
FIG. 8 is a sectional view of one embodiment of the present invention.
Figure 9:
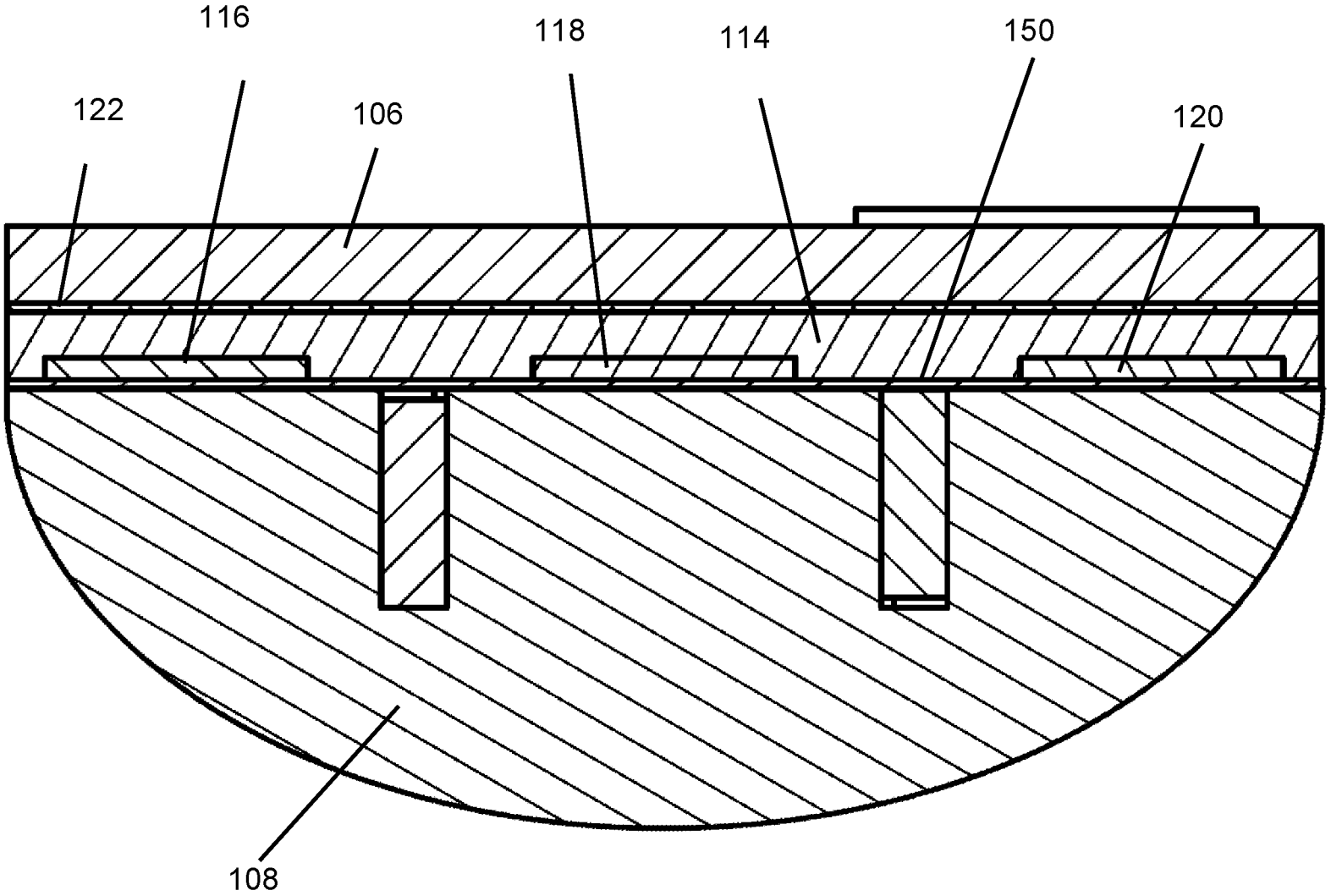
FIG. 9 is a sectional view of one embodiment of the present invention.
Figure 10:
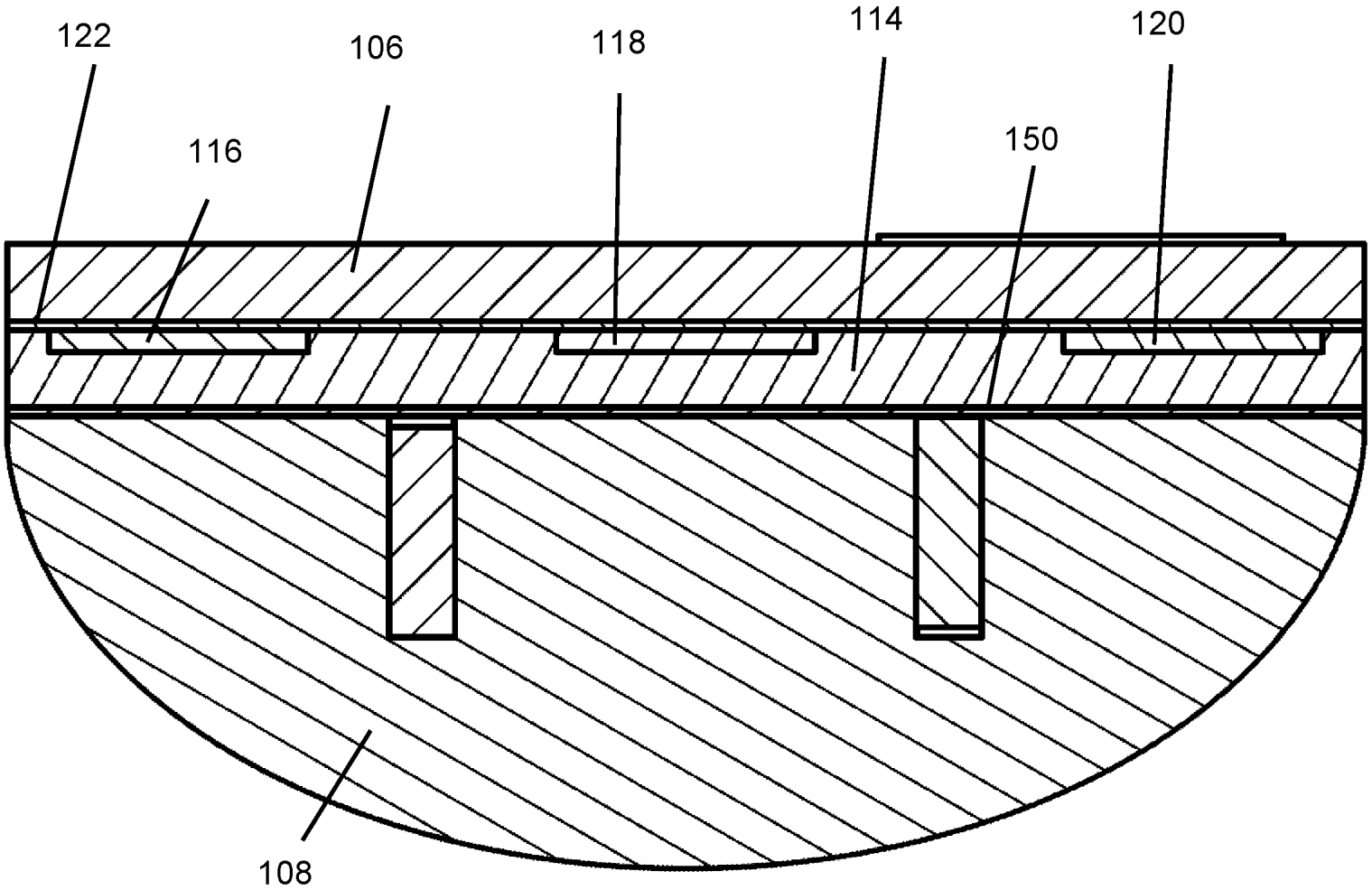
FIG. 10 is a sectional view of one embodiment of the present invention.

FIGS. 8-10 show cross sections of other embodiments of the present invention from the cross section shown in FIG. 1. FIGS. 8-10 show different arrangements of the magnets 116, 118, 120 in relation to metallic layer 122. FIGS. 9 and 10 also show an additional metallic layer 150.

FIG. 8 shows the magnets 116, 118, 120 positioned in the separating layer 114 adjacent metallic layer 122. The magnets 116, 118, 120 contact the metallic layer 122 in such an embodiment. The separating layer 114 of one embodiment is constructed from the same material as fretboard 106. In one embodiment, the separating layer 114 is constructed from the materials described above. The separating layer 114 separates the magnets 116, 118, 120 from the neck 108 of the guitar. The magnets 116, 118, 120 and separating layer 114 are secured to the neck 108. Metallic layer 122 and fretboard 106 detach from the magnets 116, 118, 120 and neck 108.

FIG. 9 shows the magnets 116, 118, 120 positioned in the separating layer 114 adjacent metallic layer 150. Metallic layer 150 is constructed from a sheet metal similar to metallic layer 122 as described above. The magnets 116, 118, 120 contact the metallic layer 150 in such an embodiment. The additional metallic layer 150 provides additional reinforcement of the neck of the stringed instrument. Separating layer 114 separates the magnets 116, 118, 120 from the metallic layer 122. The separating layer 114 of one embodiment is constructed from the same material as fretboard 106. In one embodiment, the separating layer 114 is constructed from the materials described above. The metallic layer 150, magnets 116, 118, 120, and separating layer 114 are secured to the neck 108. Metallic layer 122 and fretboard 106 detach from the magnets 116, 118, 120 and neck 108.

FIG. 10 shows the magnets 116, 118, 120 positioned in the separating layer 114 adjacent metallic layer 122. The magnets 116, 118, 120 contact the metallic layer 122 in such an embodiment. Metallic layer 150 is constructed from a sheet metal similar to metallic layer 122 as described above. The additional metallic layer 150 provides additional reinforcement of the neck of the stringed instrument. The separating layer 114 of one embodiment is constructed from the same material as fretboard 106. In one embodiment, the separating layer 114 is constructed from the materials described above. The separating layer 114 separates the magnets 116, 118, 120 from the neck 108 of the guitar and the metallic layer 150. The metallic layer 150, magnets 116, 118, 120, and separating layer 114 are secured to the neck 108. Metallic layer 122 and fretboard 106 detach from the magnets 116, 118, 120 and neck 108.

Figure 11:
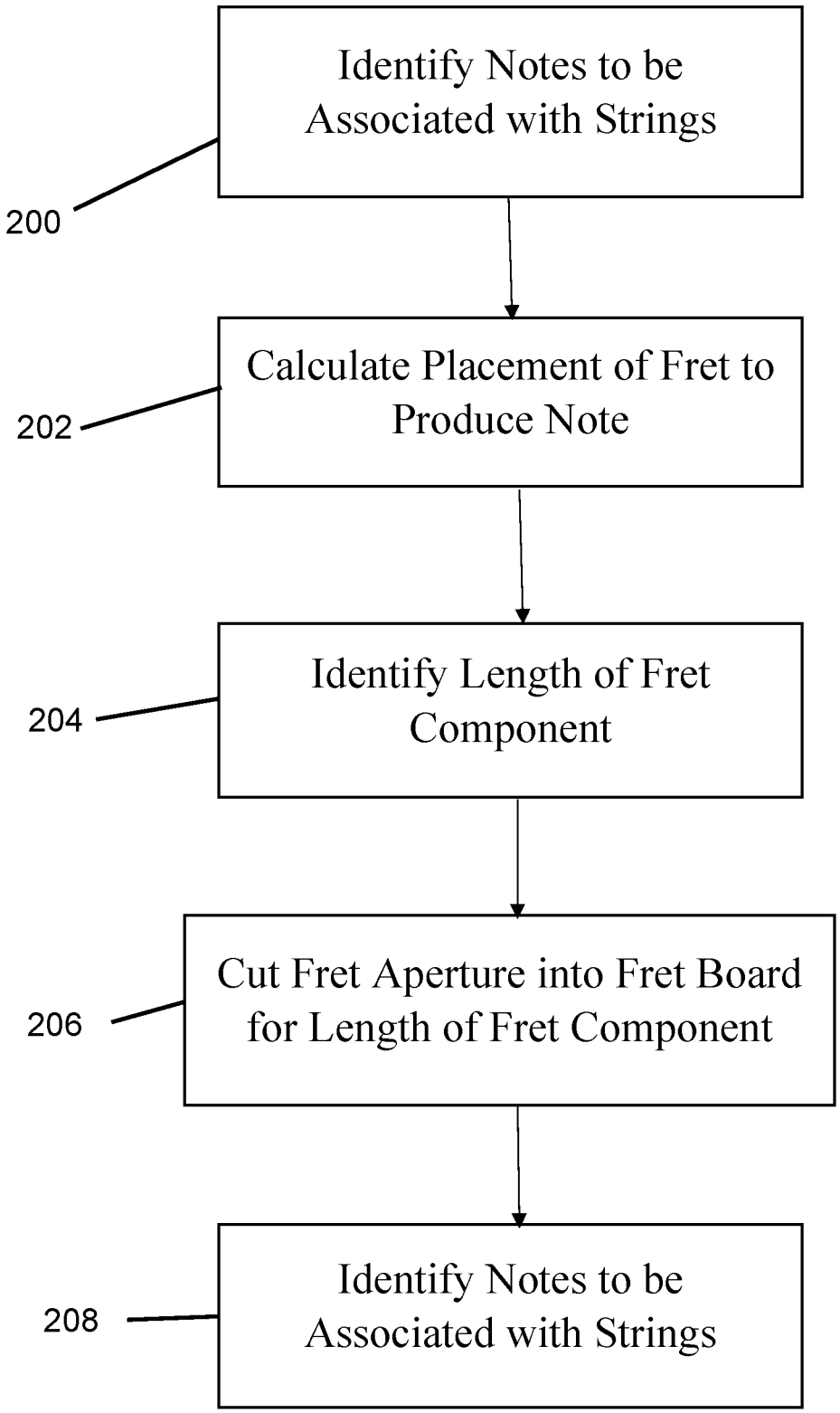
FIG. 11 is a flowchart view showing one embodiment of the present invention.

The present invention also provides a method for manufacturing a customized fretboard as shown in FIG. 11. The fretboard places fret segments along the fretboard for assisting the artist. The fret segments are placed along the fretboard to assist the artist with creating the identified notes.

The customized fretboard places the frets along the fretboard to produce sounds identified by the artist. The artist identifies the notes to be associated with each string of the stringed instrument at Step 200. These notes specified by the user are input into a computing device. The computing device calculates the placement of the frets to produce the notes identified by the artist at Calculation Step 202.

The computing device also calculates the length of each fret segment to be installed at each identified location at Identify Length Step 204. A machine or a user may then cut the specified lengths of fret wire to form the fret segment.

The computing device may supply the information needed for the length of the cutting machine to cut the desired length of the fret segment. The cutting machine then cuts the appropriate lengths of fret wire for each fret segment of the fretboard.

The computing device also supplies the placement of the fret apertures to be cut into the fretboard to a machine. The machine forms the fret apertures in the appropriate location for each fret segment at Cutting Step 206.

After the fret apertures are formed into the fretboard, each fret segment must be installed into the fret apertures at Installation Step 208. Each fret segment is inserted into the appropriate fret aperture. In one embodiment, the fret segments are hammered into the appropriate fret aperture.

The customized fretboard is then installed onto the stringed instrument via magnets. The user may then play the stringed instrument with customized fret placement for the artist's desired usage.

Figure 12:
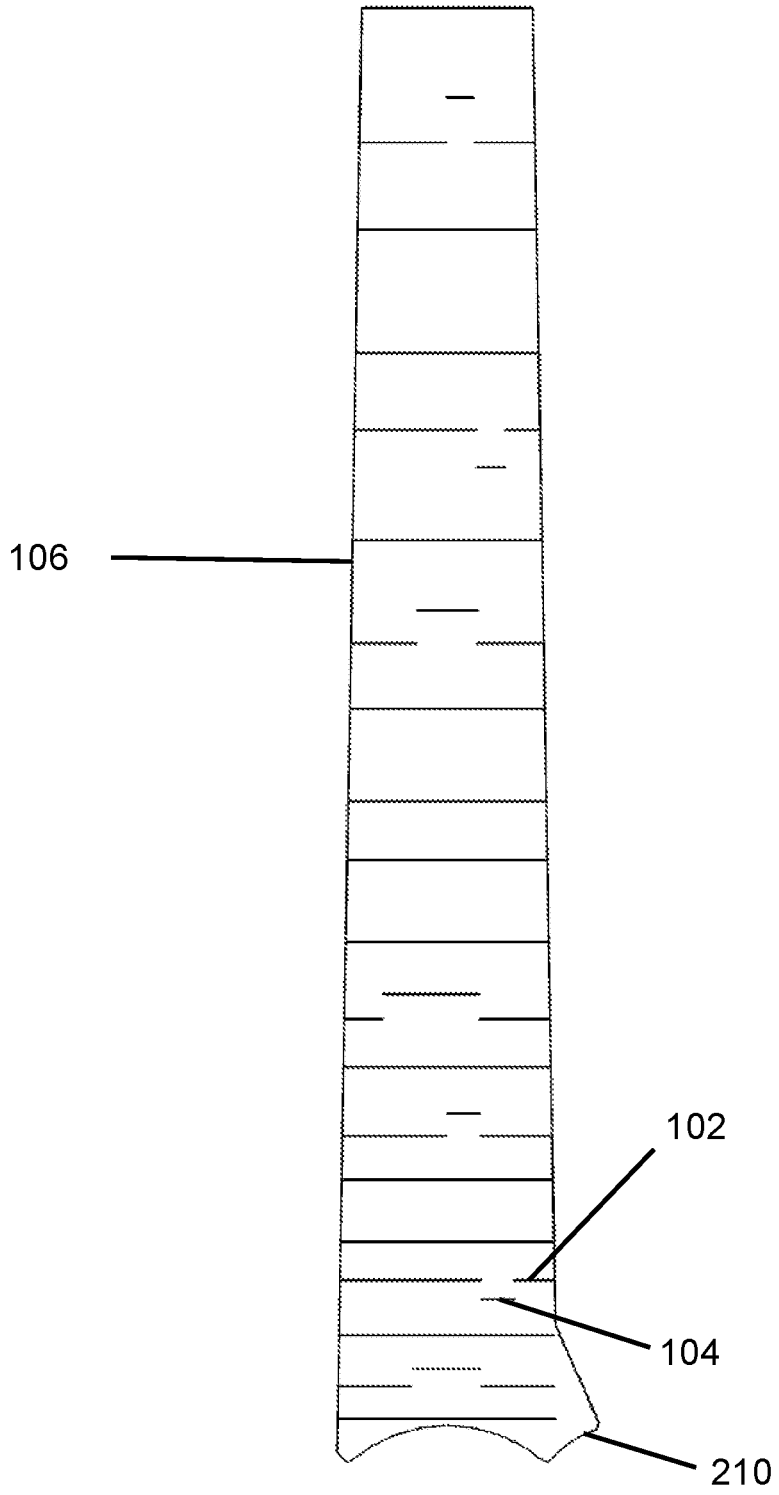
FIG. 12 is a front view of a fretboard of one embodiment of the present invention.
Figure 13:
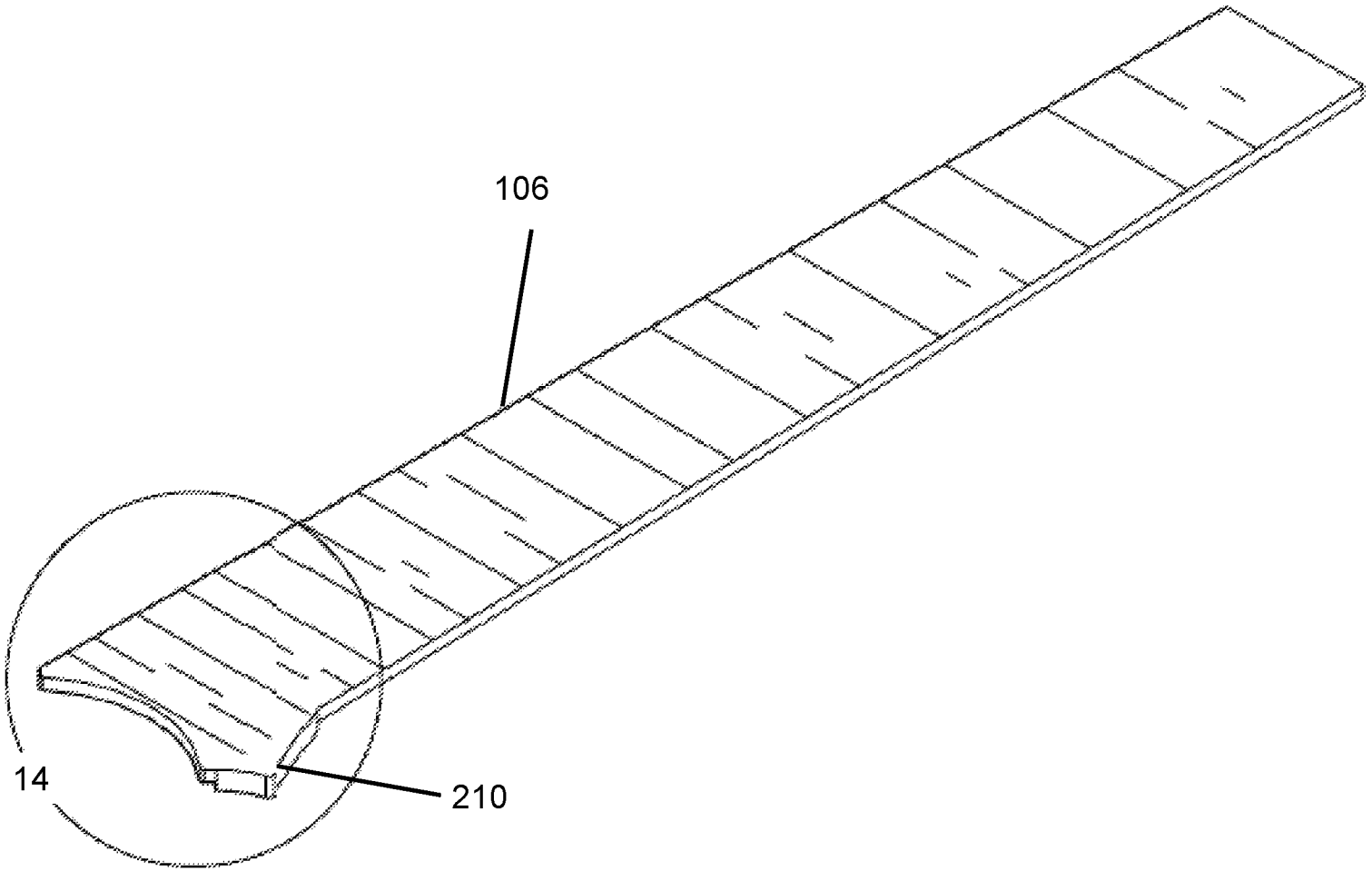
FIG. 13 is a perspective view thereof.
Figure 14:
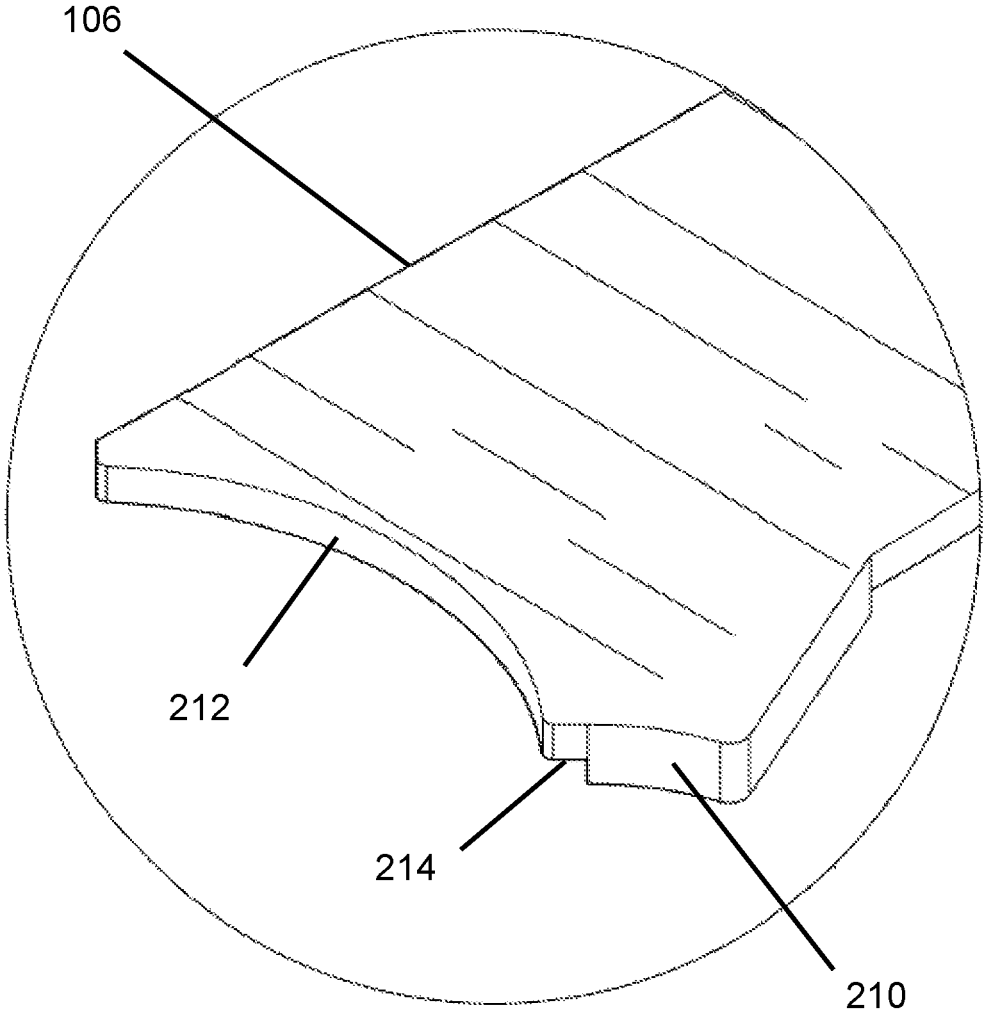
FIG. 14 is a perspective view showing a portion thereof.

FIGS. 12-14 show another embodiment of the fretboard 106. The fretboard 106 of this embodiment may include the fretboard or the fretboard component discussed above having the fretboard attached with the metallic layer, such as the sheet metal 122 shown in FIGS. 3 and 5. The fretboard 106 provides the adjustment finger 210. The adjustment finger 210 extends laterally outward from the fretboard. The lateral extension of the adjustment finger provides a surface that extends laterally outward from the neck. The adjustment finger is positioned laterally from the neck to provide a surface for the user to grip the fretboard 106. The user may grab the adjustment finger 210 for removing the fretboard 106 from the neck of the stringed instrument.

The adjustment finger 210 is located adjacent the curve 212 of the fretboard 106. Tab 214 provides extra surface for the user to grab the adjustment finger 210. The tab 214 is located between the curve 212 and the adjustment finger 210.

Figure 15:
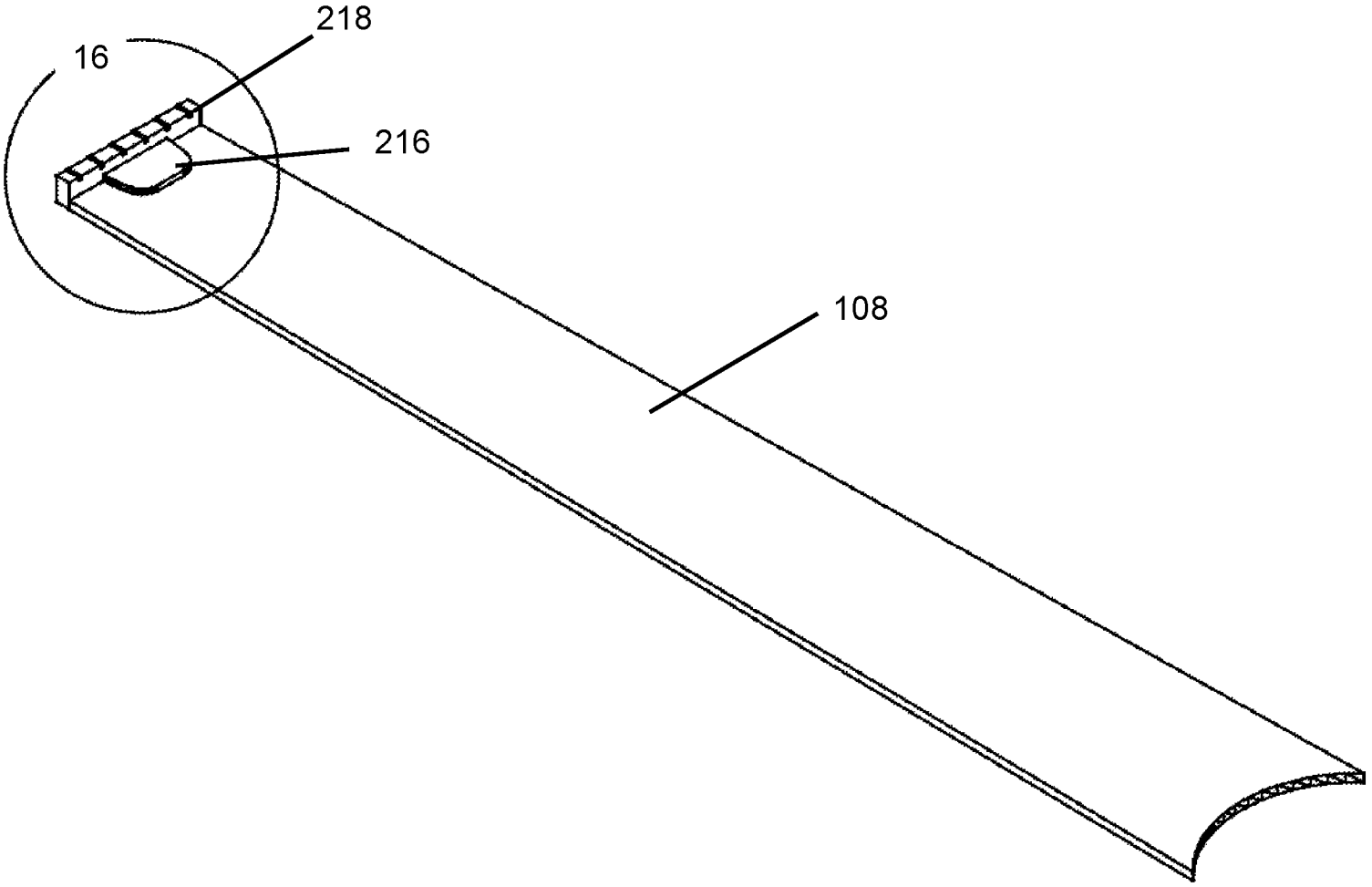
FIG. 15 is a perspective view of a neck of one embodiment of the present invention.
Figure 16:
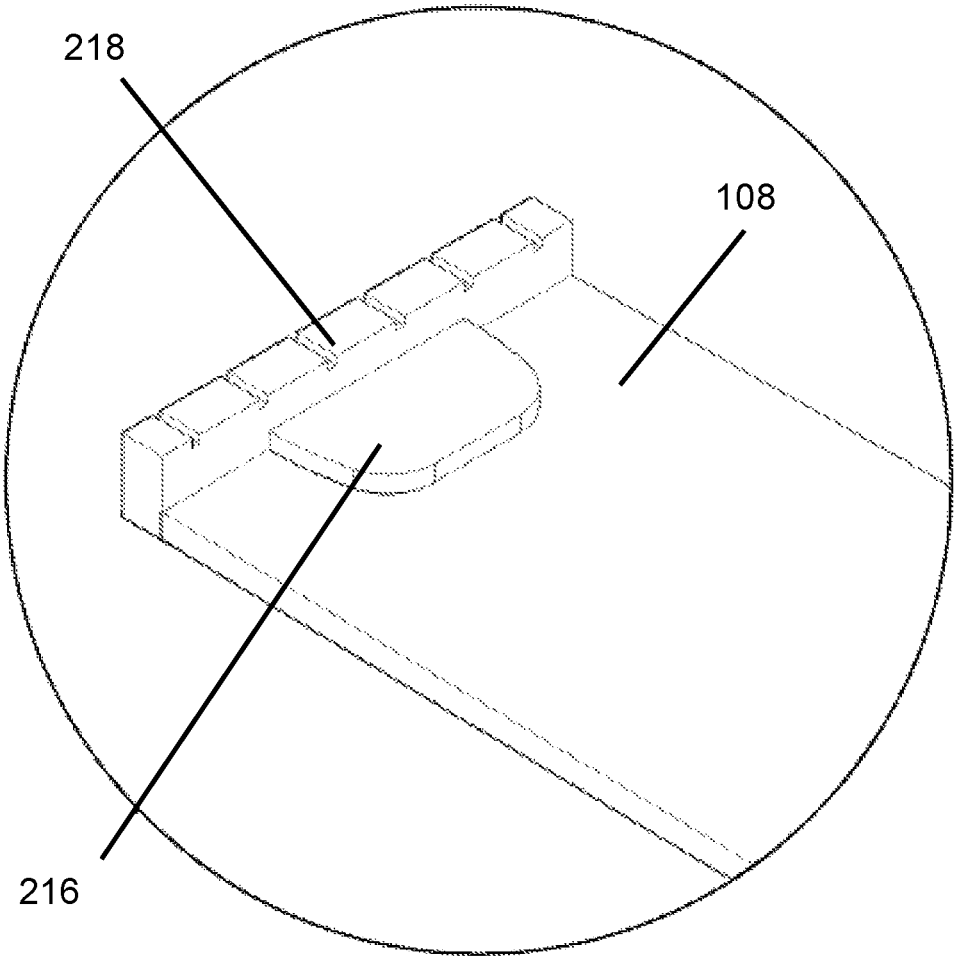
FIG. 16 is a perspective view showing a portion thereof.

FIGS. 15 and 16 show the neck 108 of one embodiment of the present invention. The neck of one embodiment may be a neck or a neck component as discussed above constructed from one or more of the separating layer 114, the magnets and magnet arrangements, and metallic layer 150 as discussed above.

The guide finger 216 of the neck is positioned against the nut 218. The guide finger 216 provides a curved surface that is raised above the neck 108. The guide finger 216 provides a surface that guides the fretboard onto the neck. The guide finger 216 also positions the fretboard onto the neck. The fretboard 106 provides a corresponding guide aperture 222 shown in FIGS. 19 and 20. The guide finger 216 mates with the guide aperture 222 to align the fretboard 106 with the neck.

Figure 17:
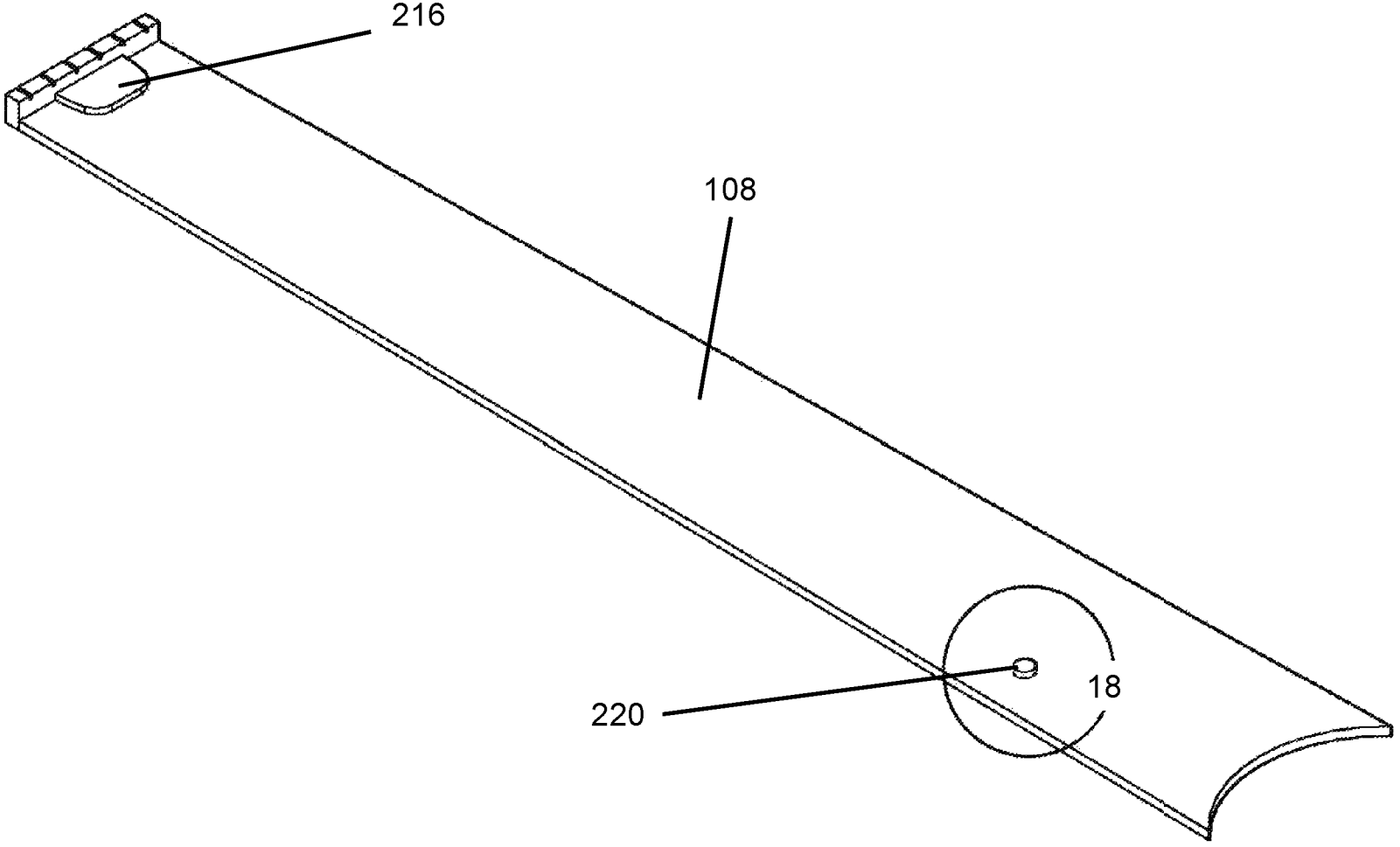
FIG. 17 is a perspective view of a neck of one embodiment of the present invention.
Figure 18:
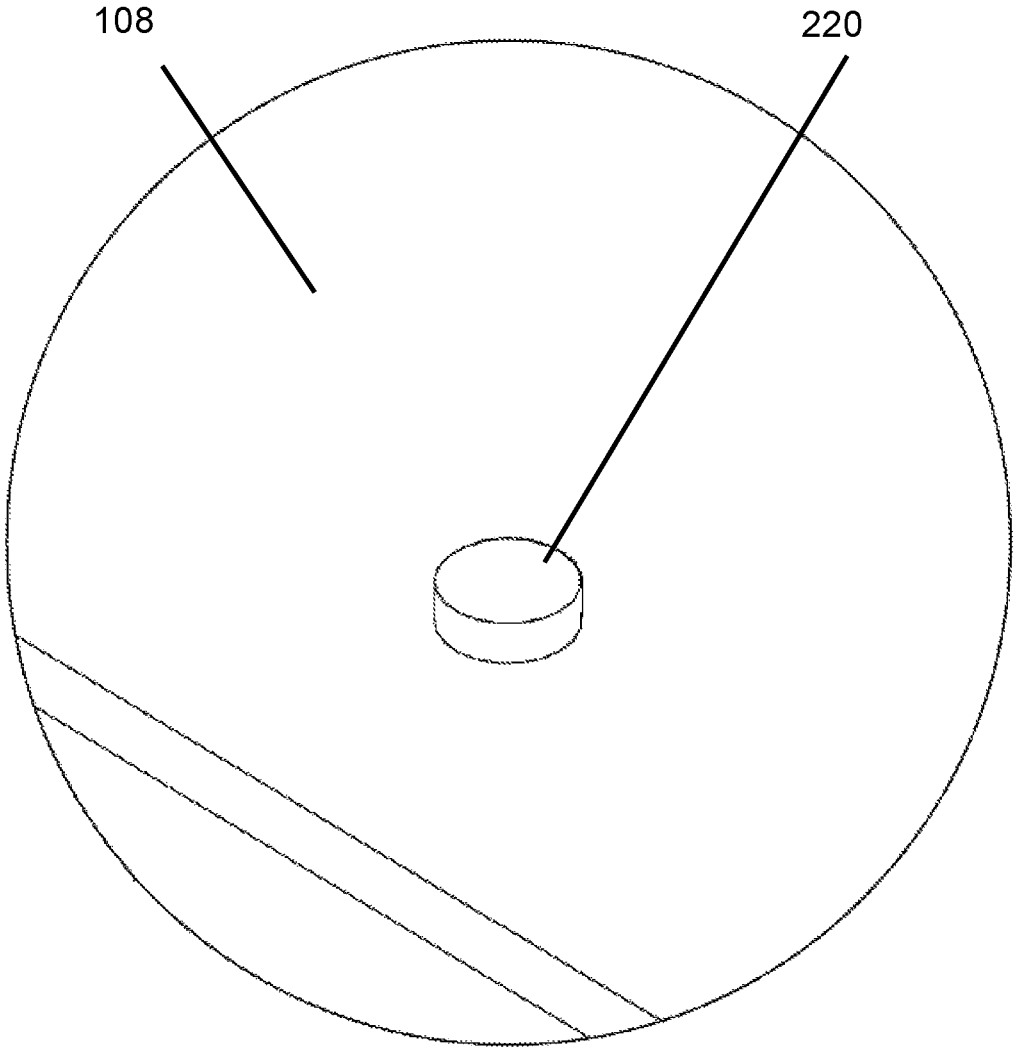
FIG. 18 is a perspective view showing a portion thereof.

FIGS. 17 and 18 show the attachment finger 220. The attachment finger 220 is raised above the neck 108 similar to guide finger 216. The attachment finger 220 guides the fretboard 106 onto the neck. The guide finger 216 and the attachment finger 220 are located at different sides of the neck 108 located longitudinally from the center of the neck. The guide finger 216 and the attachment finger 220 provide two different contacts for securing the two ends of the fretboard to the neck. The guide finger 220 and the attachment finger are located longitudinally on two different sides of the center of the neck 108.

Figure 19:
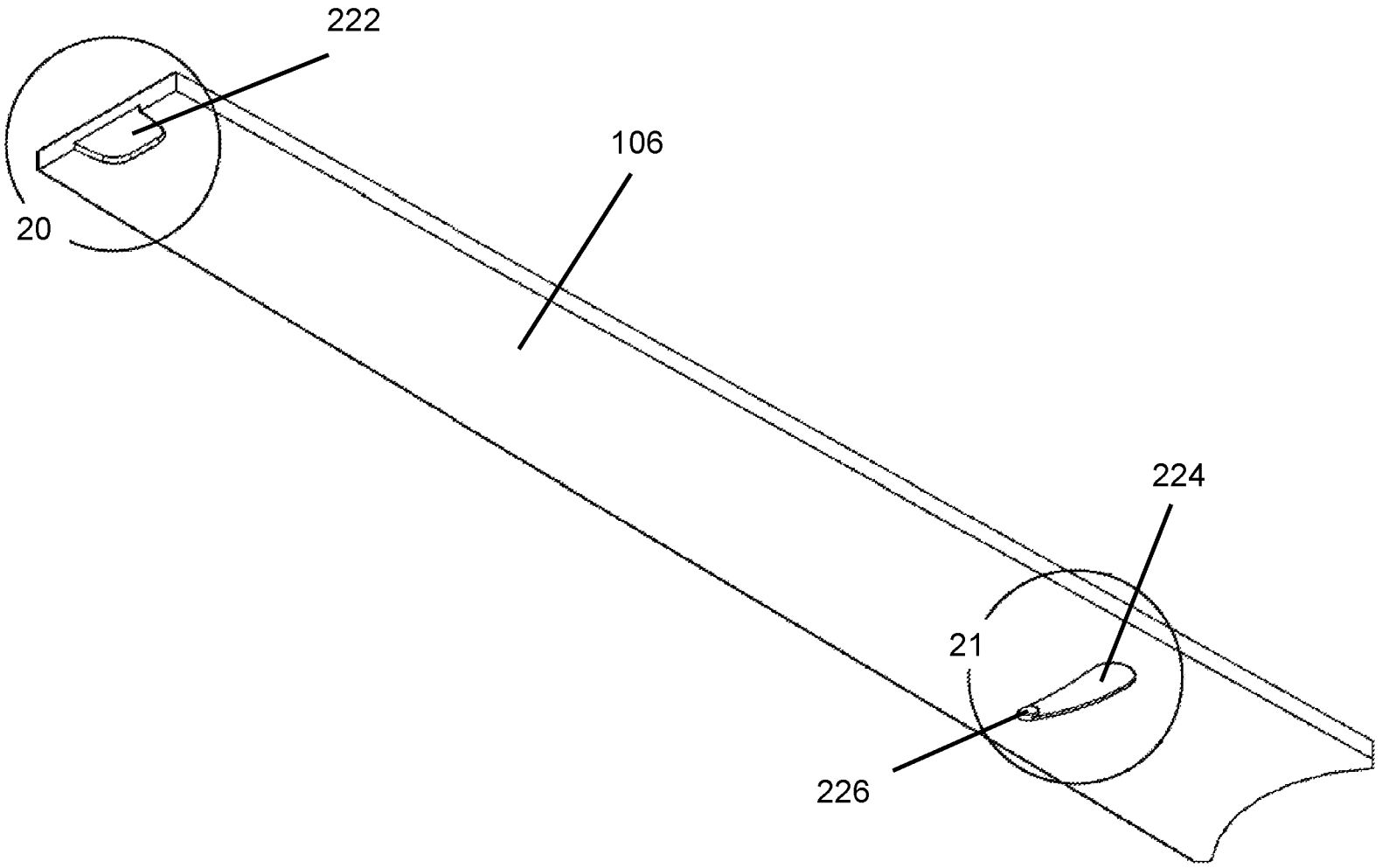
FIG. 19 is a perspective view of a fretboard of one embodiment of the present invention.
Figure 21:
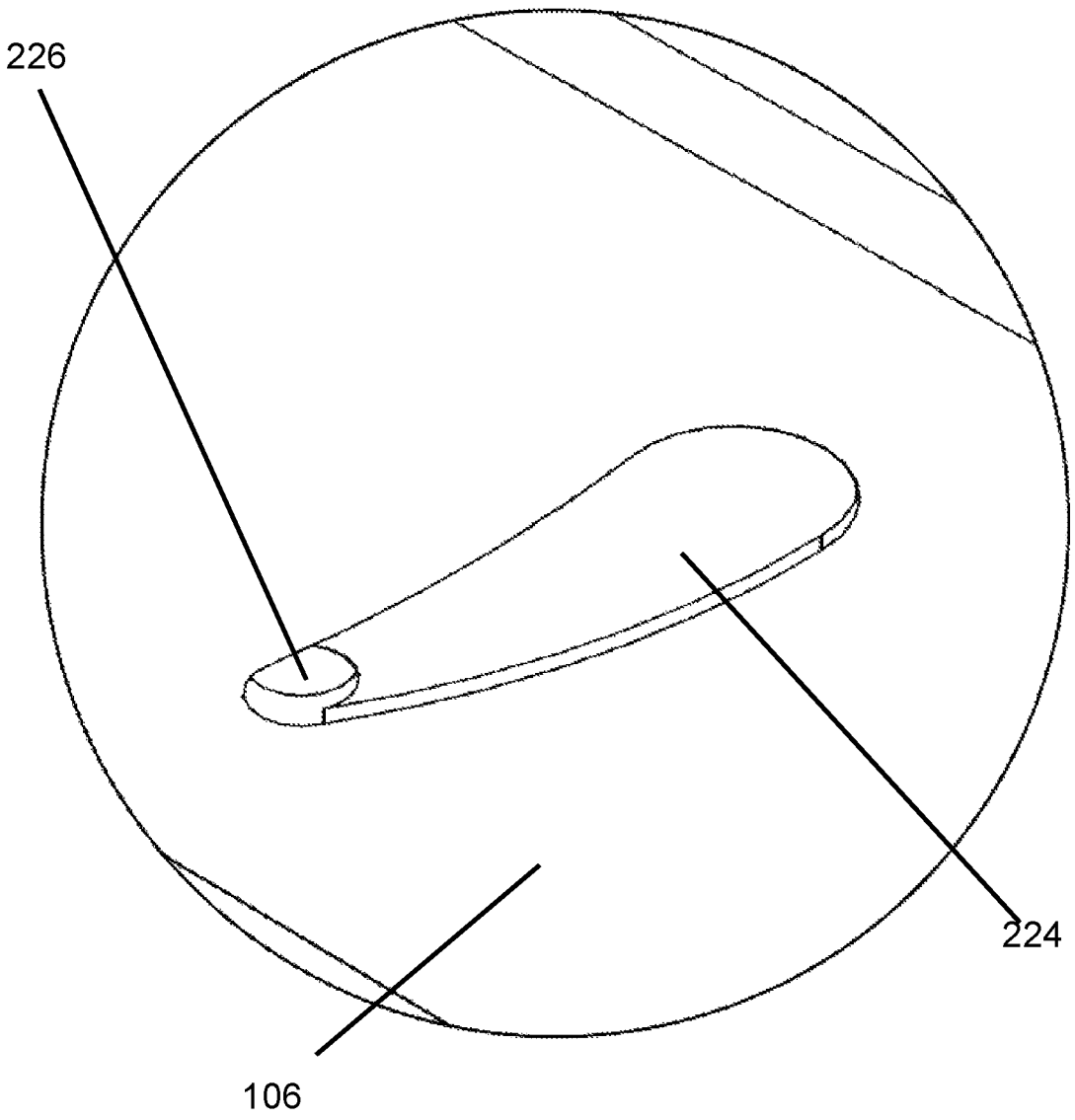
FIG. 21 is a perspective view showing a portion thereof.

The attachment finger 220 fits within the track 224 and the attachment aperture 226 of the fretboard shown in FIGS. 19 and 21. The track 224 is recessed within a rear surface of the fretboard 106. The attachment finger 220 inserts into the track 224. In one embodiment, the track 224 terminates prior to reaching the lateral edge of the fretboard 106.

The track 224 guides the attachment finger 220 to the attachment aperture 226. The track 224 narrows to the attachment aperture 226 to direct the attachment finger into the attachment aperture 226. The attachment aperture 226 of one embodiment is recessed deeper into the rear surface of the fretboard than the track 224. The attachment finger 220 inserts into the attachment aperture 226 to place the fretboard 106 flush with the neck 108.

Figure 20:
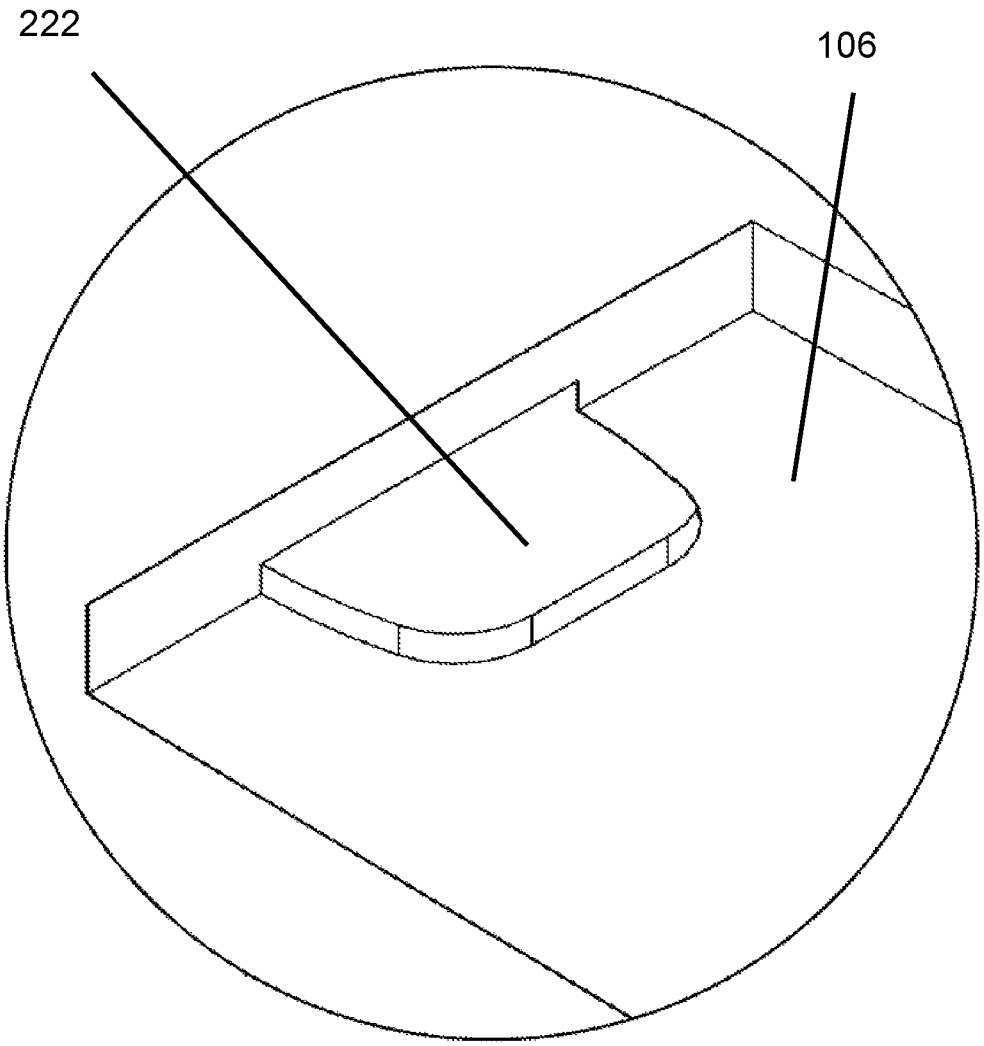
FIG. 20 is a perspective view showing a portion thereof.

FIGS. 19-21 show the guide aperture 222, the track 224, and the attachment aperture 226 of the fretboard 106. The fretboard 106 of this embodiment may include the fretboard or the fretboard component discussed above having the fretboard attached with the metallic layer, such as the sheet metal 122 shown in FIGS. 3 and 5. The guide aperture 222 and the attachment aperture 226 are located on two different longitudinal sides from the center of the fretboard 106.

The guide finger 216 of the neck 108 inserts into the guide aperture 222 of the fretboard 106. The curvature of the guide finger 216 and the guide aperture 222 secure one end of the fretboard with the neck 108. The curvature allows the alignment of the fretboard 106 with the neck 108.

FIGS. 19 and 21 show the track 224 and attachment aperture 226. Track 224 guides the attachment finger 220 shown in FIG. 17 to the attachment aperture 226. The track 224 provides a recess in the rear surface of the fretboard 106. The recess of the track 224 guides the attachment finger 220 to the attachment aperture 226. The track 224 narrows towards the attachment aperture 226 to direct the attachment finger to the attachment aperture 226.

The attachment aperture 226 is recessed deeper into the rear surface of the fretboard 106 than the track 224. The attachment finger 220 inserts into the attachment aperture 226 to cause the fretboard 106 to be flush with the neck 108. The fretboard 106 does not sit flush with the neck 108 when the attachment finger 220 is in the track 224.

The attachment finger and the guide finger position the fretboard onto the neck. Mating the attachment finger with the attachment aperture and the guide finger with the guide aperture aligns the fretboard onto the neck. Mating the attachment finger with the attachment aperture and the guide finger with the guide aperture also reduces movement of the fretboard on the neck.

The guide aperture and the attachment aperture have been described as being on the fretboard. The fretboard may include the fretboard of the system that includes a metallic layer such as the sheet metal secured to the fretboard. Such guide aperture and attachment aperture provide a recess in the rear surface of the fretboard. The guide aperture and the attachment aperture may also extend through the metallic layer, including the sheet metal, of the fretboard. Extending through the metallic layer, such as the sheet metal, allows the installation of the fretboard with the metallic layer onto the neck.

The neck 108 has been described as a neck of a stringed instrument. The neck may include the neck of the system that includes the separating layer 114, the metallic layer 150, the reinforcing members, the magnets and/or magnet arrangement, or other variations of the neck described for the system.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A detachable fretboard system for a stringed instrument wherein the fretboard system attaches to a neck of the stringed instrument comprising:

a fretboard;

a fret aperture located on a front surface of the fretboard;

a fret segment inserted into the fret aperture;

a metallic layer secured to the fretboard, wherein the metallic layer is located between the front surface of the fretboard and the neck when the fretboard is secured to the neck;

a magnet secured to the neck of the stringed instrument.

2. The system of claim 1 wherein the metal secured to the fretboard is a metallic layer secured to a rear surface of the fretboard.

3. The system of claim 2 wherein the metallic layer is constructed from a sheet metal.

4. The system of claim 1 further comprising:

a separating layer secured to the neck wherein the separating layer is located between the magnet secured to the neck and the fretboard when the fretboard secures to the neck.

5. The system of claim 4 wherein the separating layer is constructed from the same material as the fretboard.

6. The system of claim 5 wherein the separating layer and the fretboard are constructed from a phenolic resin/cellulose composite material.

7. The system of claim 4 wherein the separating layer is constructed from a phenolic resin/cellulose composite material.

8. The system of claim 1 further comprising:

a reinforcement groove extending longitudinally along the neck;

a reinforcing member installed into the reinforcement groove wherein the reinforcing member extends longitudinally along the neck.

9. The system of claim 8 wherein the reinforcing member is constructed from a carbon fiber.

10. The system of claim 1 further comprising:

at least five rows of at least three magnets secured to the neck wherein the rows of at least three magnets are located longitudinally across the neck, wherein the at least three magnets are located laterally across the neck.

11. The system of claim 10 wherein the metal secured to the fretboard is a metallic layer of a ferrous metal secured to a rear surface of the fretboard;

a separating layer secured to the neck wherein the separating layer is located between the rows of at least three magnets secured to the neck and the metallic layer of the fretboard.

12. A detachable fretboard system for a stringed instrument wherein the fretboard system attaches to a neck of the stringed instrument comprising:

a fretboard;

a magnet secured to the neck of the stringed instrument;

a fret aperture located on a front surface of the fretboard;

a fret segment inserted into the fret aperture; and a metallic layer secured to the fretboard, wherein the metallic layer is located between the fret segment and the neck when the fretboard is secured to the neck.

13. The system of claim 12 wherein the metallic layer is constructed from a sheet metal secured to a rear surface of the fretboard.

14. The system of claim 12 further comprising:

a separating layer secured to the neck wherein the separating layer forms an outer surface of the neck, the separating layer located between the magnet secured to the stringed instrument and the metallic layer secured to the fretboard when the fretboard attaches to the neck.

15. The system of claim 14 wherein the separating layer is constructed from the same material as the fretboard.

16. The system of claim 14 wherein the separating layer is constructed from a phenolic resin/cellulose composite material.

17. A detachable fretboard system for a stringed instrument wherein the fretboard system attaches to a neck of the stringed instrument comprising:

a fretboard extending along a longitudinal axis;

a fret aperture located on a front surface of the fretboard;

a fret segment inserted into the fret aperture;

a guide aperture located at a longitudinal end of the fretboard, wherein the guide aperture forms a recess within a rear surface of the fretboard, the rear surface located opposite the fret aperture.

18. The system of claim 17 further comprising:

an attachment aperture located on the rear surface of the fretboard, wherein the attachment aperture forms a recess into the rear surface of the fretboard.

19. The system of claim 18 further comprising:

a track located on the rear surface of the fretboard adjacent the attachment aperture, wherein the track forms a recess within the rear surface of the fretboard, wherein the attachment aperture is recessed deeper into the rear surface than the track, wherein the track narrows to the attachment aperture.

20. The system of claim 19 further comprising:

a center of the fretboard, wherein the guide finger is located longitudinally aft of the center, wherein the attachment aperture and track are located longitudinally fore of the center.

* * * * *